US005971317A

United States Patent [19]

Jaros

[11] Patent Number: 5,971,317

[45] Date of Patent: Oct. 26, 1999

[54] WARP RESISTANT MOLDED PLASTIC REEL

[75] Inventor: Mark E. Jaros, Metamora, Mich.

[73] Assignee: Creative Techniques, Inc., Auburn Hills, Mich.

[21] Appl. No.: 09/216,290

[22] Filed: Dec. 18, 1998

[51] Int. Cl.[6] ..... B65H 75/08

[52] U.S. Cl. ..... 242/614; 242/607; 242/608.4; 242/609.1; 242/610.6

[58] Field of Search ..... 242/607, 608, 242/608.2, 608.4, 608.6, 609, 609.1, 610, 610.1, 610.2, 610.3, 610.6, 613, 614, 118.32, 118.6, 118.7, 118.8

[56] References Cited

U.S. PATENT DOCUMENTS

| | | | |
|---|---|---|---|
| 1,905,488 | 4/1933 | Nack | 242/607 |
| 2,058,133 | 10/1936 | Clemmons | 242/607 |
| 2,110,626 | 3/1938 | Hayward | 242/607 |
| 2,115,481 | 4/1938 | Clemmons | 242/607 |
| 3,284,021 | 11/1966 | Ryll et al. | 242/609.1 |
| 3,563,487 | 2/1971 | Starratt | 242/608.4 |
| 3,942,741 | 3/1976 | Hussar et al. | 242/118.7 |
| 4,580,743 | 4/1986 | Bauer et al. | 242/118.6 |
| 4,895,316 | 1/1990 | Salloum | 242/607 |
| 4,997,142 | 3/1991 | Grant | 242/118.6 |
| 5,004,179 | 4/1991 | Salloum | 242/607 |
| 5,242,129 | 9/1993 | Bailey et al. | 242/607 |
| 5,246,184 | 9/1993 | Trewhella, Jr. | 242/608.4 |

*Primary Examiner*—Donald P. Walsh
*Assistant Examiner*—Emmanuel M. Marcelo
*Attorney, Agent, or Firm*—Harness Dickey & Pierce P.L.C.

[57] ABSTRACT

A large, warp resistant, reel is formed of a molded plastic cylindrically shaped hub with disk-like flanges co-axially arranged upon and secured to the opposite ends of the hub The flanges are each formed of a framework of numerous, spaced apart, radially extending spokes, and spaced apart concentric hoops. The spokes intersect the hoops and are integrally joined thereto. Thin, rigid co-planar plastic sheets extend across the spaces between, and are integrally joined to, the adjacent portions of the spokes and hoops. The spokes are generally T-shaped in cross-section with the heads of the T-shape being wide and thin and integrally formed on the inner, facing surfaces of the flanges and the legs of the T-shape being narrow and long and integrally formed on the outer surfaces of the flanges.

8 Claims, 2 Drawing Sheets

FIG-1
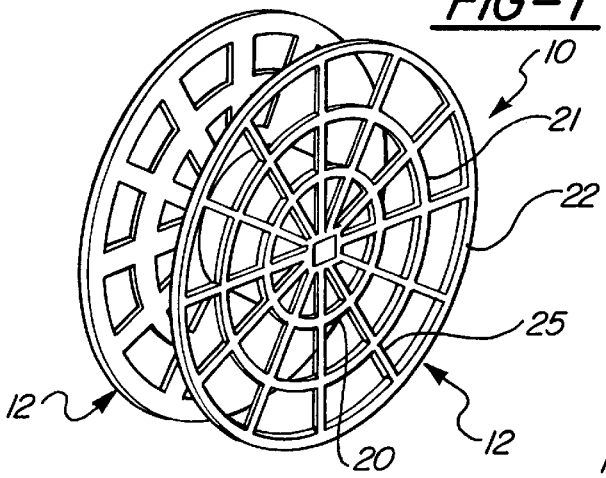
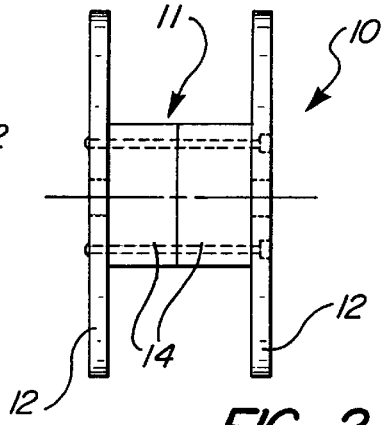
FIG-2
FIG-3
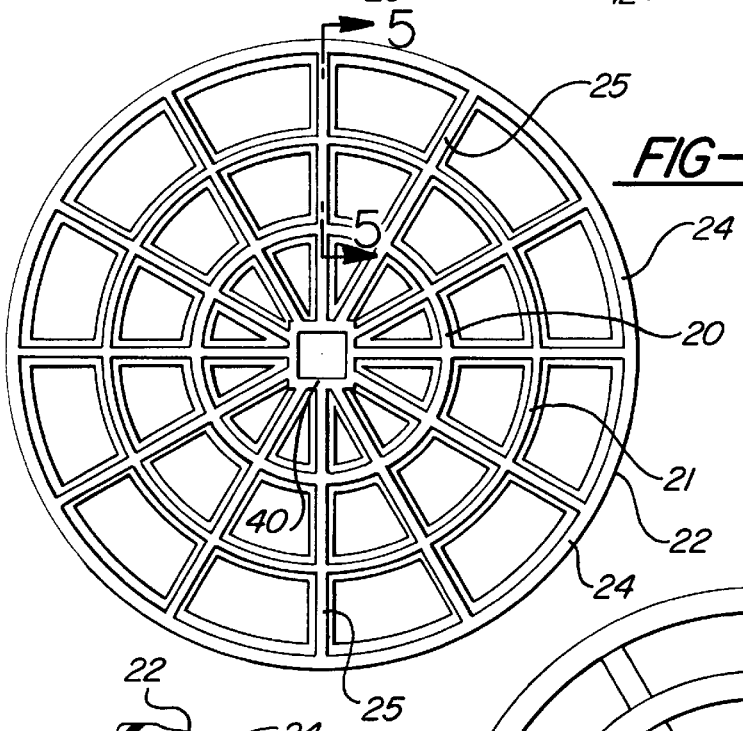
FIG-4
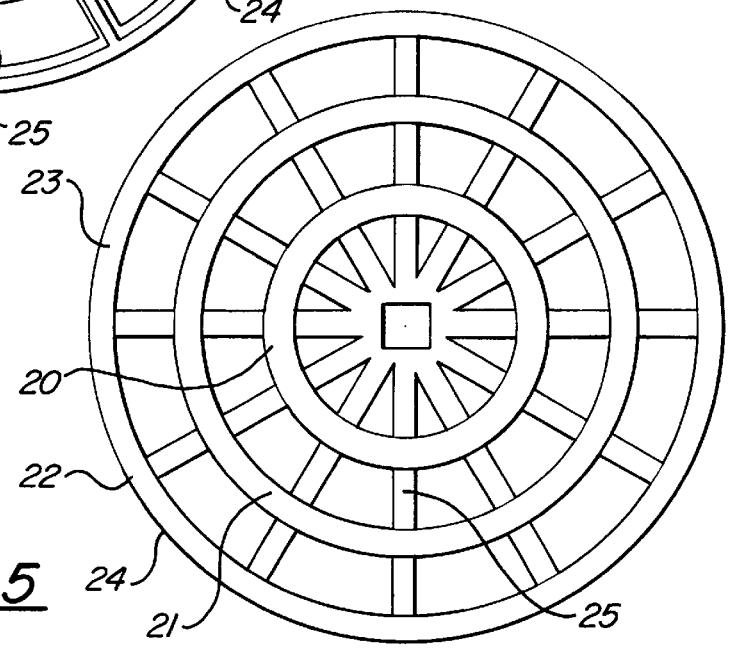
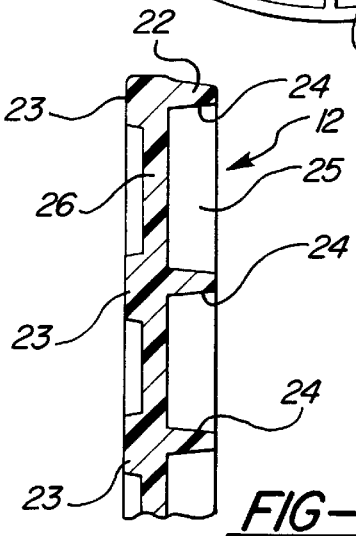
FIG-5

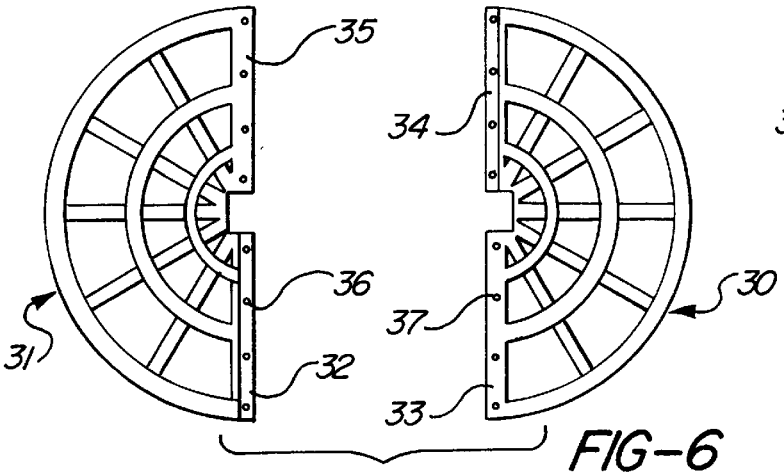
FIG-6
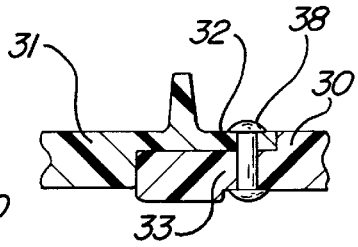
FIG-7
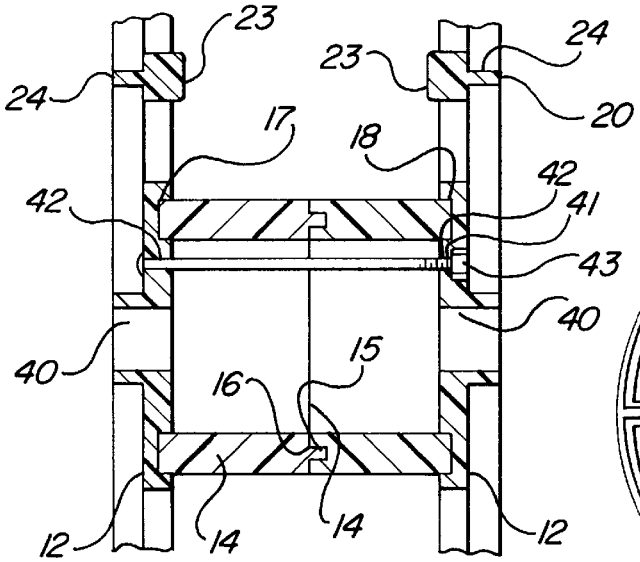
FIG-8
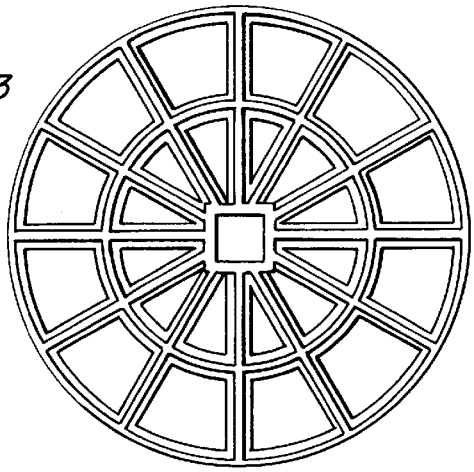
FIG-9
FIG-10
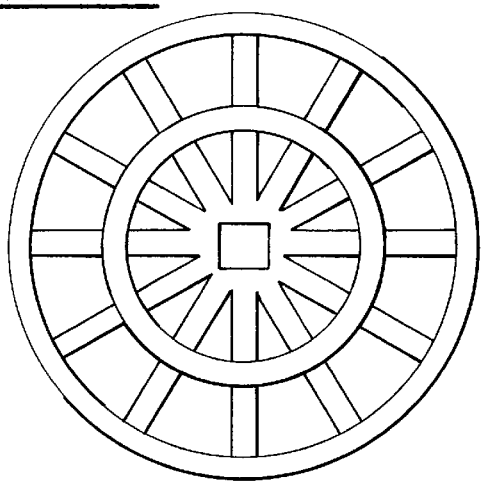
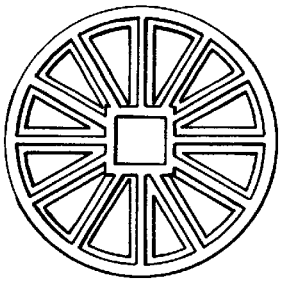
FIG-11

WARP RESISTANT MOLDED PLASTIC REEL

BACKGROUND OF INVENTION

This invention relates to a large size, molded plastic reel of the type, for example, disclosed in U.S. Pat. No. 4,895,316 issued Jan. 23, 1990 to James S. Salloum and U.S. Pat. No. 5,004,179 issued Apr. 2, 1991 to James S. Salloum.

Large size reels, such as may be used for carrying cables, strips of rubber-like or plastic materials and the like, typically comprise a hub and disk-like flanges secured to the opposite ends of the hub. Typically, such flanges may run on the order of about two feet to six or seven feet in diameter. The sizes of such reels vary considerably; however, they are large enough to carry heavy weights. In addition, such reels may be subjected to substantial impact loads due to movements or impacts occurring in shipping or transporting and using the reels. Further, they are subjected to varying temperatures and ambient weather conditions. Thus, such reels are normally made of strong and heavy materials.

By way of example, variations of large size reels which are heavy-duty for carrying heavy loads are disclosed in U.S. Pat. Nos. 1,702,242 issued Feb. 19, 1992 to Bureau; No. 2,190,013 issued Feb. 13, 1940 to Byers; No. 2,624,526 issued Jan. 6, 1953 to Green; No. 3,704,838 issued Dec. 5, 1972 to Bernier; No. 3,881,668 issued May 6, 1975 to Poteat; No. 4,083,508 issued Apr. 11, 1978 to Pattillo; No. 4,406,422 issued Sep. 27, 1983 to Philips; No. 4,412,661 issued Nov. 1, 1983 to Wise et.al.; British Patent No. 23,773 issued Nov. 6, 1902 to Sutcliffe; and, French Patent No. 808,511 issued Nov. 14, 1936 to Societe des Etablissements Cadoux. The reels disclosed in each of these patents are generally large size and fabricated with a central hub and opposing disk-like flanges. Reels or spools such as those disclosed in the foregoing patents typically are expected to hold considerable weights. The more recent, above-mentioned U.S. Pat. Nos. 4,895,316 and 5,004,179 disclose reels that are sectional in construction and made of molded plastic parts which are assembled together and which can be disassembled when desired. That type of sectional reel can be made in large sizes. Because of the sectional construction, the sizes of, and the expenses involved in fabricating the molds needed for molding the sections may be considerably reduced. More specifically, the reel components, that is the hubs and the flanges, are formed of smaller sections that are interconnected for assembling the reel. The flanges may be molded in varying diameters within a single mold. That is, the mold may be large enough to produce a large size section, which can be assembled with other identical sections, to form a flange, or outer portions of the mold may be blocked off for molding smaller size flange sections. The sections that form the flanges are generally frame-like in construction.

Reels that are of substantial size and molded in the manner disclosed in the forgoing U.S. Pat. Nos. 4,895,316 and 5,004,179, depending upon the plastic materials used and the sizes and the thicknesses of the components, can warp under field conditions involving substantial changes in temperature and other ambient conditions. Also, they can be damaged when impacted with relatively heavy forces. For example, accidentally dropping a reel off the back of a truck or accidentally striking the reel with a moving truck, can damage such reels. An advantage of such reels is that if they are damaged, the damaged sections can be removed and replaced so that the reel can remain operative. But, it would be desired to have such a plastic molded reel which will resist warping and damage caused by severe impacts. Thus, the present invention relates to a large size, sectional reel made of a molded plastic material, which will substantially resist breakage or damage due to impacts and which will resist warping in ambient temperature changes.

SUMMARY OF INVENTION

This invention contemplates providing a large size reel formed of molded plastic material and having a hub with disk-like flanges. The flanges are formed of frameworks comprising concentric hoops which are integrally interconnected with radially directed spokes and with co-planar sheets filling the spaces between adjacent hoops and spokes. The sheets prevent warping of the frame constructions and resist damage to the flanges which may be caused by impacts while simultaneously closing off access to the space between the flanges and around the hub.

An object of this invention is to provide a rigid, warp resistant, impact resistant frame-type flange formed of molded plastic material for large size reels which are utilized for carrying coils of heavy materials such as cables, strips of plastic and the like.

Another object of this invention is to provide a frame-type flange construction for plastic molded reels which lends itself to being molded in different sizes in the same plastic mold by blocking outer portions of the mold during the molding process.

Still another object of this invention is to provide a relatively inexpensive reusable, molded plastic reel having frame-type flanges which, although of relatively light weight, is strongly resistant to warping and damage due to dropping or directly applied impacts.

These and other objects and advantages of this invention will become apparent upon reading the following description, of which the attached drawings form a part.

DESCRIPTION OF DRAWINGS

FIG. 1 is a perspective view of a reel made in accordance with this invention.

FIG. 2 is a side elevation view of the reel.

FIG. 3 is an enlarged, elevational view of the exposed, exterior face of one of the flanges of the reel.

FIG. 4 is a view of the interior face of the flange of FIG. 3.

FIG. 5 is an enlarged, fragmentary view of the flange taken in the direction of arrows 5—5 of FIG. 3.

FIG. 6 is an elevational view of two sections forming the flange with the sections disassembled and spaced apart.

FIG. 7 is an enlarged, fragmentary view of the joint between the two flange sections.

FIG. 8 is an enlarged, schematic, fragmentary cross-sectional view of the hub and flanges showing their connections to each other.

FIG. 9 illustrates an elevational view of a smaller size flange.

FIG. 10 illustrates the interior or reverse face of the flange illustrated in FIG. 9.

FIG. 11 illustrates a still smaller diameter flange made in the same mold used for the flange of FIGS. 3 and 9.

DETAILED DESCRIPTION

FIGS. 1 and 2 illustrate a reel 10 formed with a hub 11 and opposite flanges 12. As illustrated in FIGS. 2 and 8, the hub 11 may be formed of a series of hub rings or cylinders 14 which are fitted together end-to-end to provide the desired hub length. Thus, each ring or cylinder is formed with a tongue 15, which may be continuous or discontinuous, on one of its ends and a groove 16 on its opposite end. The tongue 15 fit into the grooves 16 to engage the rings end-to-end. As shown in FIG. 8, the opposite ends of the assembled hub are inserted in corresponding grooves 17 and 18 formed in the flanges 12.

The flanges 12 are each formed of a framework of concentric hoops and intersecting radially-directed spokes. Although the number of hoops may vary, the drawings illustrate, for exemplification purposes, an inner hoop 20, surrounded by a middle hoop 21, which in turn is surrounded by an outer hoop 22. As schematically illustrated in FIG. 5, the hoops are each T-shaped in cross-section to provide a flat, thin, wide head portion 23 and a narrow, elongated leg portion 24.

Radially directed spokes 25 intersect the hoops and are formed integral with the hoops at the intersections. The spokes are formed in the same T-shape cross-section that is used for the hoops. Thus, the hoops and spokes provide a framework for each of the flanges 12. The spaces in the framework, that is, the spaces between adjacent hoops and spokes, are filled with integral sheets 26. These sheets are co-planar and are aligned in a plane that is located between the planes containing the heads 23 and the legs 24 of the T-shaped hoops. This is illustrated in FIG. 5. Thus, the otherwise open framework is completely or substantially closed by the co-planar sheets and the sheets are located outwardly of the heads of the spokes and hoops and inwardly of the leg portions of the spokes and hoops.

Preferably, the flanges are made in a number of substantially identical sections rather than in one complete molded unit. FIG. 6 illustrates, by way of example, a flange made of two semicircular sections 30 and 31. The adjacent lower edge portions 32 and 33 of the upper edge portions 34 and 35 of the sections are overlapped to form a continuous joint. These edge portions are provided with holes 36 and 37 that are aligned and through which fasteners 38, such as screws, bolts, rivets or the like are inserted for connecting the sections together. The number of sections may vary. For example, the flange may be formed of four identical sections molded in the same plastic-forming mold.

The centers of the flanges are provided with socket openings 40 which may be square or of other shapes, to receive an axle upon which the reel may be mounted. For reinforcement purposes, a suitable bearing or bushing may be inserted in the opening. However, this is not illustrated and is optional.

To fasten the flanges to the hub, long bolts 41 may be passed through openings 42 in the flanges and secured by nuts 43 to clamp and hold the assembled hub sections and flanges together. To maintain the alignment between the hub sections and to prevent the bolts from shifting, the cylinders forming the hub may have internal passageways molded therein for holding and guiding the bolts. That construction is not illustrated since it forms no part of this invention.

In order to manufacture the reel, a suitable plastic-forming mold may be made of one of the sections of the flange. Thus, a number of sections can be formed in the same mold and assembled together as described above. In the event that a smaller diameter flange is desired, for a smaller diameter reel, the mold outer portions may be blocked off to eliminate the outer hoop and outer portions of the spokes and the corresponding sheets filling the outer areas of the mold. FIG. 9 illustrates a smaller diameter flange which is made of sections, as in the case of the flange of FIG. 6. These sections would be made in a mold having its outer areas blocked off so as to eliminate the outer portions of the section. In that way, one expensive mold may be utilized to make smaller diameter flanges as well as larger diameter flanges. FIG. 10 shows the interior face of the flange of FIG. 9 and illustrates that the flange is of the same construction, but of a lesser diameter, as the flanges illustrated in FIGS. 3 and 4.

Similarly, more of the mold may be blocked to make an even smaller flange as illustrated in FIG. 10. FIG. 10 illustrates, for example purposes, the elimination of the two outer hoops to form a considerably smaller diameter flange.

The width of the hub may be changed by varying the number of cylinders assembled together in the manner illustrated in FIG. 8. This construction provides flexibility in manufacturing different diameter and width reels utilizing the same molding equipment. In each case, the flange construction, that is, the framework and the sheet construction, provides a highly warp resistant structure. In addition, the flanges have considerable strength, normally enough to resist heavy impacts. By utilizing a sufficiently strong plastic of sufficient thickness, as determined by one skilled in the art, if a reel, loaded with cable or with coiled strip material, falls off a delivery truck or material handling device or is struck by a moving vehicle, the reel would have sufficient strength to resist breakage.

This invention may be further developed within the scope of the following claims. Accordingly, it is desired that the foregoing description be read as being merely illustrative of an operative embodiment of this invention and not in a strictly limiting sense. Having fully described at least one operative embodiment.

I now claim:

1. A warp resistant reel formed of a plastic material and comprising a central hub with radially outwardly extending, generally flat, disk-like flanges secured on the opposite ends of the hub:

said flanges each having an outer exposed surface and an inner surface facing towards the opposite flange;

said flanges each being formed of a framework made of numerous, spaced apart spokes extending radially inwardly from the peripheral edge of the flange towards the central axis of the flange;

each spoke being approximately T-shaped in cross-section to form a wide, flat head portion located on the flange inner surface and a narrow leg portion located on the flange outer surface;

each flange having at least one approximately T-shaped, in cross-section, hoop arranged co-axially relative to the central axes of the hub and flanges, with the spokes intersecting and integrally joined to the hoop;

with the hoop having a wide, flat head portion arranged substantially co-planar with the spoke head portions and a leg portion arranged substantially co-planar with the spoke leg portions;

and substantially co-planar, flat sheets integrally joining and extending between adjacent spokes and said hoop and located in a plane that is between the planes of the hoop and spoke heads and the hoop and spoke legs to substantially close the spaces between the spokes and the hoop.

2. A reel as defined in claim 1, and with the legs of the spoke portions being longer, in cross-sectional height dimension normal to the plane of said sheets, than the head portions of the T-shaped spokes.

3. A reel as defined in claim 1, and with the spokes having a number of concentric hoops, with the spokes intersecting and being intregrally joined to each of the respective hoops.

4. A reel as defined in claim 3, and with the flanges being formed of separate, substantially identical sections which are each segments of a circle and which have free radially directed edges that are arranged to engage corresponding edges of their adjacent sections, and with the sections being mechanically connected together along their engaged edges.

5. A reel as defined in claim 4, and said hub being formed of substantially identical cylinders arranged end-to-end, with the outer free ends of the hub arranged against their adjacent flanges, and mechanical fasteners securing the cylinders and flanges together.

6. A warp resistant, plastic molded reel comprising:

a central, generally cylindrically shaped hub and disk-like flanges secured upon the opposite ends of, and arranged co-axially to, the hub;

said flanges having generally planar inner surfaces facing each other and outer, exposed planar surfaces;

each flange being formed of a network of numerous, spaced apart spokes which radially extend from the outer periphery of the flange towards the central axis of the flange;

and said framework including generally circular, spaced apart hoops arranged co-axially with the flange, and with the spokes each intersecting and being integrally joined with the respective hoops;

a relatively thin, connector sheet of molded plastic material extending across each of the spaces between, and being integrally joined with, adjacent spokes and hoops so that the flanges are substantially solid;

and the sheets being co-planar with each other and located in a plane that is between the planes defining the inner and outer surfaces of the spokes and hoops, so that each spoke has an inner portion extending inwardly of the inner surface of its respective flange and has an outer portion extending outwardly of the outer surface of its respective flange, relative to the plane of the connector sheets.

7. A reel as defined in claim 6, and with the portions of the spokes located on the inner surfaces of the flanges being wide in the axial direction of the reel axis and thin in the direction transverse of the reel axis, and the portions of the spokes extending outwardly of the outer surfaces of the flanges being substantially narrower and thicker than the dimensions of the corresponding parts of the portions of the spokes located on the inner surfaces.

8. A claim as defined in claim 7, and wherein the hub is formed of substantially identical cylinders arranged end-to-end and the flanges being formed in substantially identical sections which are segments of a circle, with each of the sections having free radially directed edges which overlap and are normally secured to the corresponding edge of the adjacent section, and mechanical fasteners securing the hub cylinders and flanges together for assembly of the reel and for correspondingly for disassembly of the reel.

* * * * *